United States Patent [19]

Bartels

[11] 4,279,956

[45] Jul. 21, 1981

[54] FABRIC FOR USE IN PROTECTION FOR CHAIN SAWS

[75] Inventor: Bruce E. Bartels, Cambridge, Canada

[73] Assignee: Wheelabrator Corporation of Canada Limited, Canada

[21] Appl. No.: 135,183

[22] Filed: Mar. 28, 1980

[30] Foreign Application Priority Data

Feb. 14, 1980 [CA] Canada ..... 345658

[51] Int. Cl.[3] ..... B32B 23/02; B32B 3/00

[52] U.S. Cl. ..... 428/192; 2/16; 2/22; 139/407; 428/81; 428/102; 428/193

[58] Field of Search ..... 428/81, 192, 193, 194, 428/195, 196, 102, 103, 104; 2/16, 20, 22, 23, 24; 139/383 B, 407, 408, 409, 410

[56] References Cited

U.S. PATENT DOCUMENTS

| | | | |
|---|---|---|---|
| 4,135,025 | 1/1979 | Backes | 428/196 |
| 4,144,612 | 3/1979 | Yamaguchi | 428/102 |

*Primary Examiner*—William J. Van Balen

*Attorney, Agent, or Firm*—Staas and Halsey

[57] ABSTRACT

The invention provides a pad for protecting against injuries caused by moving chain saw blades. A plurality of superposed woven composite fabrics formed of a tough synthetic resin are firmly held together at the periphery of the pad. Each composite fabric comprises at least two superposed fabric layers which are interwoven into a single layer along spaced substantially parallel strips. The interwoven strips allow the number of fabric layers to be reduced without reducing the effectiveness of the protective pad.

15 Claims, 4 Drawing Figures

FABRIC FOR USE IN PROTECTION FOR CHAIN SAWS

The present invention relates to protective pads used by inter alia lumberjacks to protect their bodies e.g., legs, against injury due to contact with moving chain saw blades.

In the felling of trees and sawing up of the felled trees with chain saws, it frequently happens that the chain saw comes into contact with the body, e.g., the legs of the user, which contact could cause the user serious injury. It is thus conventional to provide the clothing of the user, e.g., the lumberjack, with protective pads so as to protect the areas of the body such as the legs from such injury. Such protective pads have heretofore been formed from a plurality which are sewn together around the edges, each fabric layer being formed from a nylon fabric. It is intended that the multi-layered protective pad absorb the motion of the cutting blades of the chain saw and thus causes the motor of the chain saw to stall. What happens is that, as the moving chain saw blade strikes the protective pad, the chain saw rips into the fabric layers thus tearing them apart. The fabric layers slide over one another and jam the chain saw. Of course, sufficient layers must be provided to ensure that the chain saw is stalled before it has cut right through the protective pad. In practice it has been found necessary to provide eight such layers to ensure that there is no risk of the chain saw cutting right through the pad and, in order to obtain CSA approval, eight layers of fabric have been required.

One object of the present invention is to reduce the number of required layers of fabric while ensuring adequate safety such that there is no risk of the chain saw cutting completely through the protective pad. According to the present invention therefore there is provided a pad for protecting against injuries caused by moving chain saw blades, comprising a plurality of superposed woven composite fabrics formed of tough synthetic resin and firmly held together at the periphery of the pad, each composite fabric comprising at least two superposed fabric layers which are interwoven into a single layer along spaced substantially parallel strips.

Preferably, each fabric layer is loosely woven so as to allow it to be readily deformed from its woven shape when struck by a moving chain saw blade.

The interwoven strips forming a single fabric layer in the composite fabric can extend either longitudinally or transversely of the fabric and usually for ease in weaving extend warpwise of the layer.

The fabric forming each layer is suitably a plain weave fabric and more preferably a 1/1 plain weave fabric formed of a tough synthetic resin such as nylon which is preferred or other tough synthetic resins. The weave however is not limited to a plain weave and can be any other suitable type of weave such as a twill e.g., a ½ twill weave. The fabric suitably has a count or combination of counts both on ends an/or picks of from 17 to 28, preferably 20 to 24 and for the most preferred fabric, i.e., a plain weave 1×1 nylon fabric has a count of 22×22. The yarn denier is suitably in the range 420 to 1680 denier yarns inclusive in warp and/or weft or combination of the yarns and is more preferably 630 to 1100 and in the most preferred yarn is 840×840 in warp and weft.

Suitably there are 3 to 7 ends included in each strip and more preferably 4 to 6 ends or, more generally, yarn in each strip, it has been found that with less than 3 and more than 7 ends in each strip the capability of interweaving such strips and the effectiveness of such strips is impractical and unacceptable. Suitably the composite fabric layer is formed of a plurality of fabric layers, preferably in the range 2 to 4 layers and more preferably 2 layers.

The protective pad is preferably stitched around the edges thereof and composed of three composite fabrics forming six separate fabric layers.

The preferred spacing between the interwoven strips is 7".

The composite fabric may readily be formed on conventional weaving machines which are capable of weaving a plurality of fabric layers simultaneously and by simply setting the machine so that, at the desired locations, either weftwise or warpwise and preferably the latter, the separate layers are interwoven into a single layer.

The present invention will be further illustrated by way of the accompanying drawings in which.

Figure 1:
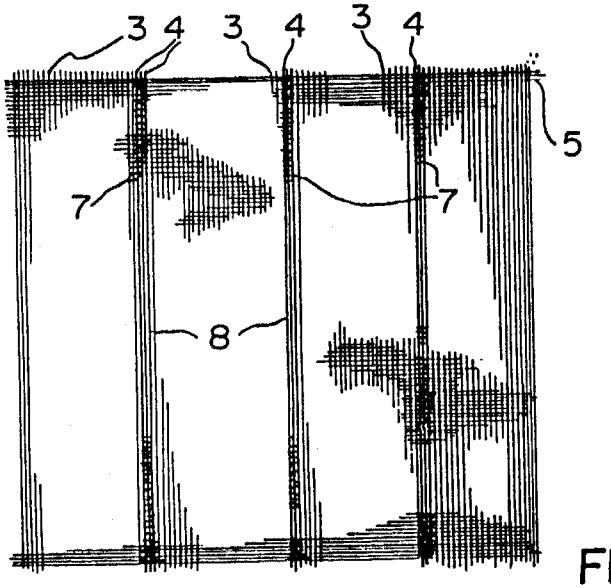
FIG. 1 is a plan view of the fabric showing only some of the warp and weft threads for convenience of illustration
Figure 2:
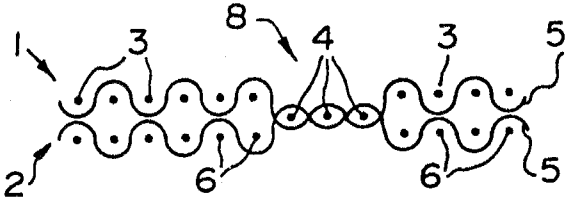
FIG. 2 is an enlarged section through a portion of the fabric containing an interwoven strip.

The composite fabric shown in FIGS. 1 and 2 comprises an upper layer 1 and a lower layer 2, both layers having a 1/1 plane weave and being formed of 840×840 denier nylon and the warp and weft. The upper layer 1 has a series of ends 3 which together with common ends 4 provide a warp which is interwoven with picks 5. The lower layer 2 has a series of ends 6 which, together with common ends 4, are interwoven with picks 7. This structure provides a composite fabric comprising two layers 1 and 2 which are interwoven into a single layer along strips 8 provided by the common ends 4.

The strips 8, as can be seen in the drawing, comprise three ends and are spaced apart by 7 inches.

Of course, if desired more ends can be used to form each interwoven strip, although preferably each such strip 8 does not contain more than 7 ends.

Figure 3:
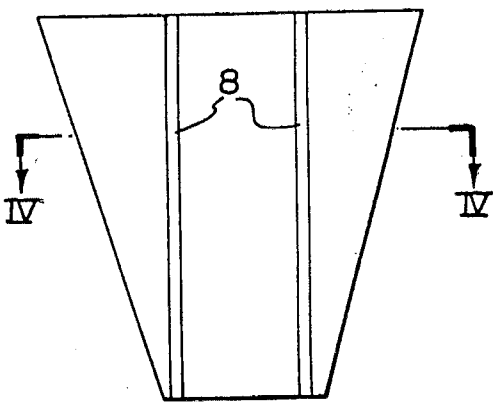
FIG. 3 is a plan view, in diagrammatic form, of a protective chain saw pad made of the composite fabric shown in FIG. 1.
Figure 4:
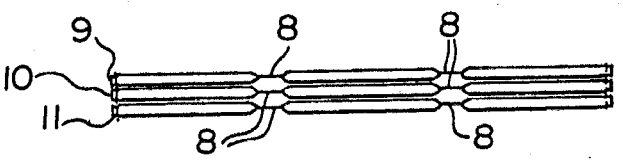
FIG. 4 is a section taken on the line 4—4 of FIG. 3.

FIGS. 3 and 4 illustrate a chain saw protective pad using the composite fabric. Three composite fabrics 9, 10 and 11 are cut into trapezoidal shape, as shown in FIG. 3, superposed, and firmly stitched together around their edges to form the three composite layer structure as shown in FIG. 4. At the upper edge, the fabric is 11 inches wide, whereas as the lower edge the fabric is 8 inches wide. The interwoven strips 8 are spaced 7 inches apart and thus the pad shown in FIG. 3 contains two such parallel strips arranged warpwise of each fabric.

Retaining means (not shown) are provided to attach the protective pad to a body part of the user such as his or her leg and knee. When a moving chain saw blade strikes the protective pad shown in FIGS. 3 and 4, there is a tendency for the chain saw blade to rip through the material causing the fabric layers to slide over one another in the conventional manner. However, the presence of the interwoven strips 8 limits the degree of relative movement between the layers of each composite fabric, while nonetheless allowing the composite fabric layers to slide over each other quite freely. Because the layers of each composite fabric are tied together along the interwoven strips, they do not rip apart quite so readily as is the case with completely separate layers. This means that the chain saw blade does not tend to cut through the fabric layers quite so quickly. However, the fact that slippage is provided over the major portion of the pad area means that the fabric still jams the chain saw as effectively as separate layers. It has thus been found that, without impairing the efficiency of the pad as a protective device, a reduced number of layers can be used as compared with a conventional chain saw pad having completely separate layers. In the pad shown in FIGS. 3 and 4, only three composite fabrics are used (making a total of six separate layers) and qualitative tests have shown this to be sufficient. The elimination of two separate layers of fabric (since eight was the minimum without the interwoven strips) enables considerable saving in material costs to be effected, as well as enabling the bulkiness of the pad to be reduced.

A further advantage of the described composite fabric is that it considerably facilitates the stitching of the fabrics together at the edges to form the protective pad. The described fabric having a count of 22×22 is a relatively open or loose weave (as this has been found to be the optimum for stalling the chain saw blade) and it has been found that, when eight such fabric layers are superposed, it is difficult to hold them in place while stitching them together. The fact that the fabric layers are now arranged in pairs, in the form of the composite fabrics, prevents the fabrics from moving around relative to each other during stitching and thereby facilitates the stitching operation. It is still further facilitated, of course, by the fact that two less layers are needed than is the case when using separate fabric layers.

In the illustrated embodiment of the fabric, the strips 8 are continuous. This is the preferred embodiment, although they can be interrupted.

The embodiments of the invention in which an exclusve property or privilege is claimed are defined as follows:

1. A pad for protecting against injuries caused by moving chain saw blades, comprising a plurality of superposed woven composite fabrics formed of tough synthetic resin and firmly held together at the periphery of the pad, each composite fabric comprising at least two superposed fabric layers which are interwoven into a single layer along spaced substantially parallel strips.

2. A pad according to claim 1, wherein each said fabric layer is loosely woven allowing it to be readily deformed from its woven shape when struck by a moving chain saw blade.

3. A pad as claimed in claim 1, in which said strips are continuous.

4. A pad as claimed in claim 3, in which the strips extend warpwise of the composite fabric.

5. A pad as claimed in claim 3, in which the composite fabric has a count on ends and picks of from 17 to 28.

6. A pad as claimed in claim 5, wherein the composite fabric has a count on ends and picks of from 20 to 24.

7. A pad as claimed in claim 5, wherein the composite fabric has a count on ends and picks of 22×22.

8. A pad as claimed in claim 5, wherein each layer of the composite fabric has a 1×1 plain weave.

9. A pad as claimed in claim 5, wherein the yarn denier of the fabric layers lies in the range 420 to 1680.

10. A pad as claimed in claim 9, wherein the yarn denier lies in the range 630 to 1100.

11. A pad as claimed in claim 10, wherein the yarn denier is 840×840 in warp and weft.

12. A pad as claimed in claim 1, wherein the strips are spaced 6 to 8 inches apart.

13. A pad as claimed in claim 1, wherein the composite fabric has only two fabric layers of 1×1 plain weave having a count of 22×22 of 840×840 denier yarn with 7 inch spacings between the strips.

14. A pad as claimed in claim 13, wherein the yarn is nylon yarn.

15. A pad as claimed in claim 14, wherein the fabrics are held together by stitching at the periphery of the pad.

* * * * *